US009534501B2

(12) United States Patent
Hung et al.

(10) Patent No.: US 9,534,501 B2
(45) Date of Patent: Jan. 3, 2017

(54) INLET GUIDE VANE ASSEMBLY

(71) Applicant: INDUSTRIAL TECHNOLOGY RESEARCH INSTITUTE, Hsin-Chu (TW)

(72) Inventors: Kuo-Shu Hung, Changhua County (TW); Jenn-Chyi Chung, Changhua County (TW); Chung-Che Liu, Hsinchu (TW)

(73) Assignee: INDUSTRIAL TECHNOLOGY RESEARCH INSTITUTE, Hsin-Chu (TW)

( * ) Notice: Subject to any disclaimer, the term of this patent is extended or adjusted under 35 U.S.C. 154(b) by 400 days.

(21) Appl. No.: 14/267,730

(22) Filed: May 1, 2014

(65) Prior Publication Data

US 2015/0167481 A1 Jun. 18, 2015

(30) Foreign Application Priority Data

Dec. 17, 2013 (TW) ..... 102146726 A

(51) Int. Cl.
*F01D 17/12* (2006.01)
*F01D 9/04* (2006.01)
(Continued)

(52) U.S. Cl.
CPC ..... *F01D 9/04* (2013.01); *F01D 17/14* (2013.01); *F01D 17/141* (2013.01);
(Continued)

(58) Field of Classification Search
CPC .... F01D 17/141; F01D 17/145; F01D 17/146; F01D 17/148; F01D 17/16; F01D 17/162; F01D 17/165; F01D 17/167; F01D 9/04
See application file for complete search history.

(56) References Cited

U.S. PATENT DOCUMENTS 3,362,624 A 1/1968 Endress
3,407,681 A 10/1968 Kiernan et al.
(Continued)

FOREIGN PATENT DOCUMENTS

CN 101351647 A 1/2009

OTHER PUBLICATIONS

Cao, Shu Liang et al., Design and experiment of inlet guide vane for centrifugal pump, China Academic Journal Electronic Publishing House, 2010, p. 1-5, 41.
(Continued)

*Primary Examiner* — Jesse Bogue
(74) *Attorney, Agent, or Firm* — Locke Lord LLP; Tim Tingkang Xia, Esq.

(57) ABSTRACT

An inlet guide vane assembly is disclosed, which comprises: a housing, configured with a first penetration part and a plurality of first grooves; at least one fixing ring, each configured with a second penetration part and a plurality of second grooves; at least one rotary ring, each configured with a third penetration part and a plurality of sliding chutes, wherein the first, the second and the third penetration parts are arranged in communication with one another; a plurality of vane units, each vane unit is composed of a vane, a linkage and a sliding block; and at least one driving unit, for driving one vane of the plural vanes to swing, thus driving the rotary ring to rotate simultaneously, bringing along the other vanes to swing, enabling the sliding blocks to slide inside corresponding sliding chutes, and consequently flipping the vane from a first state to a second state.

11 Claims, 8 Drawing Sheets

(51) Int. Cl.
*F01D 17/14* (2006.01)
*F01D 17/16* (2006.01)

(52) U.S. Cl.
CPC ..... *F01D 17/145* (2013.01); *F01D 17/146* (2013.01); *F01D 17/148* (2013.01); *F01D 17/16* (2013.01); *F01D 17/162* (2013.01); *F01D 17/165* (2013.01); *F01D 17/167* (2013.01)

(56) References Cited

U.S. PATENT DOCUMENTS 3,508,839 A 4/1970 Strub
3,853,433 A 12/1974 Roberts et al.
4,177,007 A 12/1979 Schlangen et al.
4,257,733 A 3/1981 Bandukwalla et al.
4,299,535 A 11/1981 Brockman et al.
4,558,987 A 12/1985 Dittié
4,616,483 A 10/1986 Leonard
4,652,208 A 3/1987 Tameo
4,695,220 A 9/1987 Dawson
4,867,636 A * 9/1989 Sauron ..... F03B 3/183 415/160
4,969,798 A 11/1990 Sakai et al.
5,096,374 A 3/1992 Sakai et al.
5,807,071 A 9/1998 Brasz et al.
6,039,534 A 3/2000 Stoner et al.
6,312,217 B1 * 11/2001 Takahashi ..... F01D 17/165 415/160
6,450,763 B1 9/2002 Crum et al.
7,096,657 B2 8/2006 Mahoney et al.
7,771,161 B2 * 8/2010 Battig ..... F01D 17/165 415/160
7,886,536 B2 2/2011 Hemer
8,033,782 B2 10/2011 Tapper
8,033,785 B2 10/2011 Thermos et al.
8,079,808 B2 12/2011 Sconfietti
8,156,757 B2 4/2012 Doty et al.
8,181,479 B2 5/2012 Tsukamoto et al.
8,240,983 B2 8/2012 Suljak, Jr. et al.
8,397,534 B2 3/2013 Doty et al.
2007/0231125 A1 * 10/2007 Oeschger ..... F04D 29/462 415/160
2010/0172745 A1 7/2010 Hodder
2010/0329898 A1 12/2010 Dunn et al.
2012/0121403 A1 * 5/2012 Clemons ..... F01D 17/162 415/208.1
2012/0263586 A1 * 10/2012 Patil ..... F04D 27/0246 415/208.1
2015/0125274 A1 * 5/2015 Liang ..... F04D 29/462 415/157

OTHER PUBLICATIONS

Gui, Shaobo et al., Numerical simulation and experiment of inlet guide vane pre-whirl regulation for centrifugal pump, China Academic Journal Electronic Publishing House, 2009, p. 101-106, 40, 12.

H. Mohtar et al., Variable inlet guide vanes in a turbocharger centrifugal compressor: Local and global study, SAE Technical Paper Series, 2008, World Congress, Detroit, Michigan.

L. Zhou et al., Experimental Study on the Influence of Diffuser and Inlet Guide Vane for the Performance of Centrifugal Compressor, Experimental Techniques, 2008, p. 26-33.

Armin Zemp et al., Experimental investigation of forced response impeller blade Experimental investigation of forced response impeller blade vibration in a centrifugal compressor with variable inlet guide vanes—Part 1: Blade damping, ASME, 2011, p. 1369-1380, Vancouver, British Columbia, Canada.

* cited by examiner

INLET GUIDE VANE ASSEMBLY

CROSS REFERENCE TO RELATED APPLICATION

This application also claims priority to Taiwan Patent Application No. 102146726 filed in the Taiwan Patent Office on Dec. 17, 2013, the entire content of which is incorporated herein by reference.

TECHNICAL FIELD

The present disclosure relates to an inlet guide vane assembly used in fluid machinery

BACKGROUND

Nowadays, the technique of controlling flow rate by changing guide vane angle had been applied in many fields. Taking the application in air conditioning system for example, the inlet guide vanes that are disposed in front of the impeller inlet of a centrifugal compressor are controlled at different state for varying the flow rate of the centrifugal compressor to adjust the cooling capacity accordingly. Consequently, if an air condition system is failing to precisely control its inlet guide vanes that are disposed in front of the impeller inlet of its centrifugal compressor, generally a sever energy waste can be caused as the cooling capacity can not be controlled precisely.

However, a conventional inlet guide vane is generally designed to be driven by a mechanism composed of linkages and gears, or is a gear disc mechanism being driving to rotate by a driver, and thus such conventional inlet guide vane not only can be very complex in structure, but also is difficult to design and manufacture.

SUMMARY

In an exemplary embodiment, the present disclosure provides an inlet guide vane assembly, which comprises: a housing, at least one fixing ring, at least one rotary ring, a plurality of vane units, and at least one driving unit. Moreover, the housing is configured with a first penetration part and a first end surface having a plurality of first grooves disposed thereat; the fixing ring is arranged coupling to the housing and is configured with a second penetration part and a second end surface having a plurality of second grooves disposed thereat; and the rotary ring is configured with a third penetration part and a plurality of sliding chutes disposed surrounding the periphery of the rotary ring; whereas each of the plural second groove is disposed mating to a corresponding first groove so as to form an accommodation space; the first penetration part, the second penetration part and the third penetration part are arranged in communication with one another into a passage; and the plural vane units include a first vane unit and a second vane unit and each of the vane units is composed of a vane, a linkage and a sliding block in a manner that the vane and the sliding block are disposed respectively at the two ends of the linkage, while allowing the linkage to be sandwiched between the first groove and the second groove, the vane to protrude into the passage and the sliding block to inset into the sliding chute; and the driving unit is disposed for driving one vane selected from the plural vanes to swing which is used to drive the rotary ring simultaneously, thereby bringing along the other vanes to swing, enabling the plural sliding blocks to slide inside their corresponding sliding chutes, and consequently the vane is flipped from a first state to a second state.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
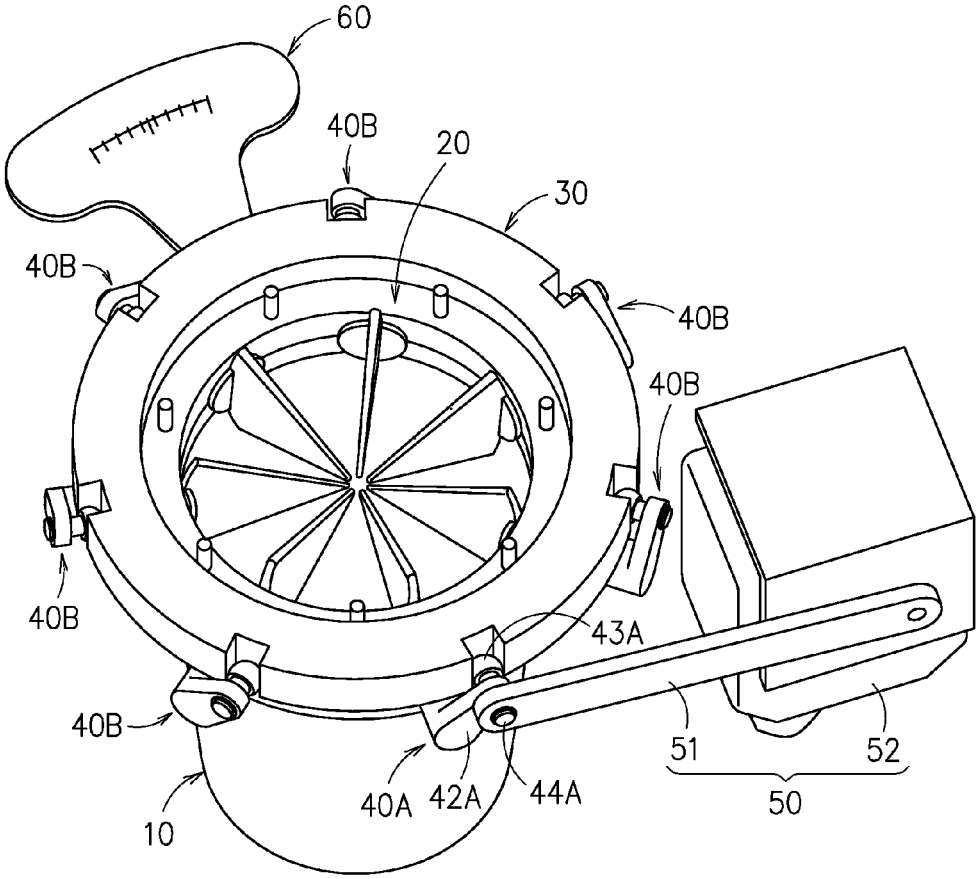
FIG. 1 is a three-dimensional view of an inlet guide vane assembly according to an embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Please refer to FIG. 1 to FIG. 5, which are schematic diagrams showing an inlet guide vane assembly according to an embodiment of the present disclosure. In this embodiment, the inlet guide vane assembly comprises: a housing 10, a fixing ring 20, a rotary ring 30, a plurality of vane units such as the two vane units 40A, 40B shown in FIG. 2, and a driving unit 50. In addition, the inlet guide vane assembly further comprises a scale indicator 60, that is disposed coupling to the rotary ring 30 and can be arranged according to actual requirement or not, whereas the type of the scale indictor 60 is not limited by the aforesaid embodiment of FIG. 1.

Figure 2:
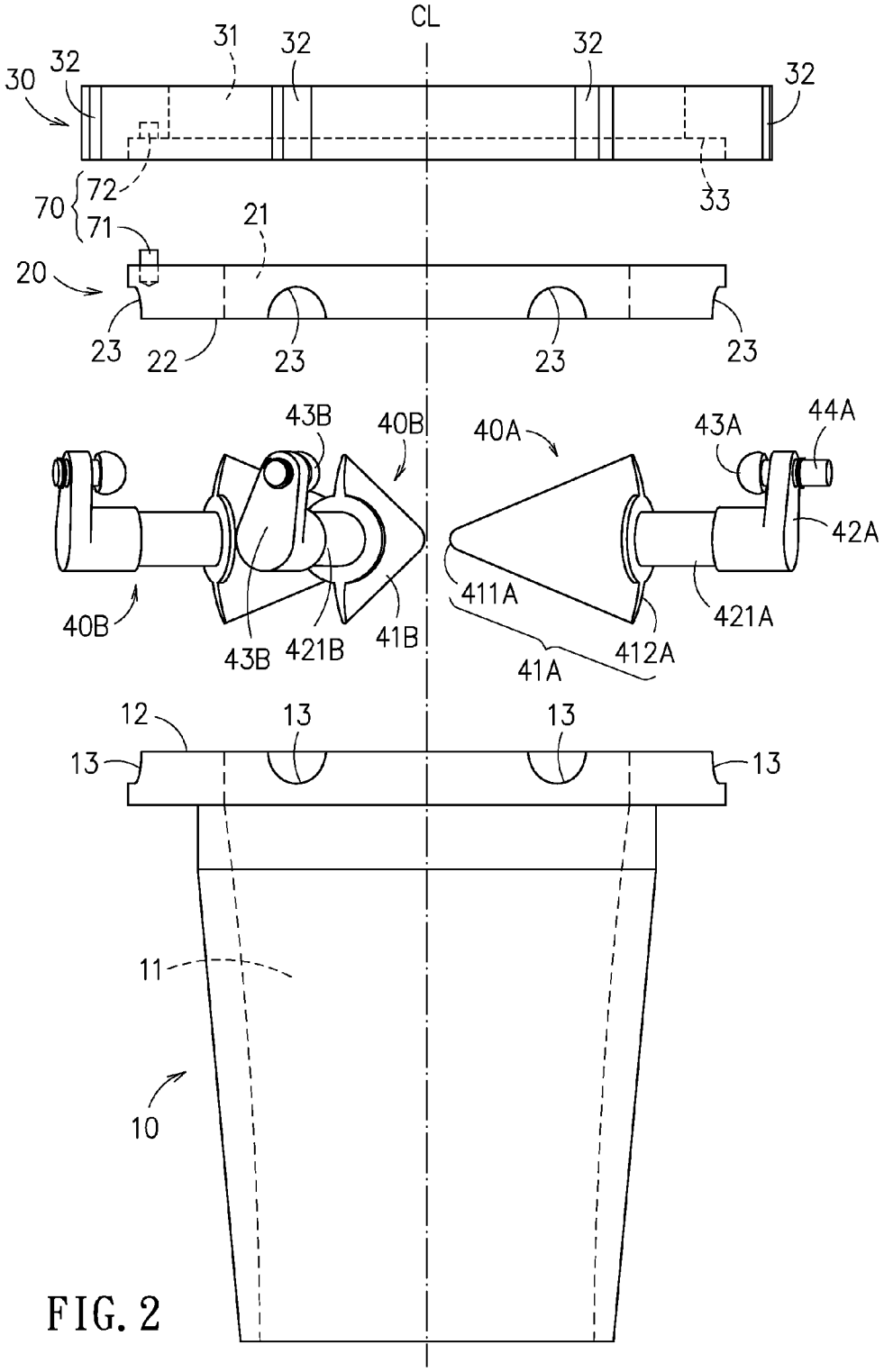
FIG. 2 is an exploded view of components used in an inlet guide vane assembly of the present disclosure.
Figure 3:
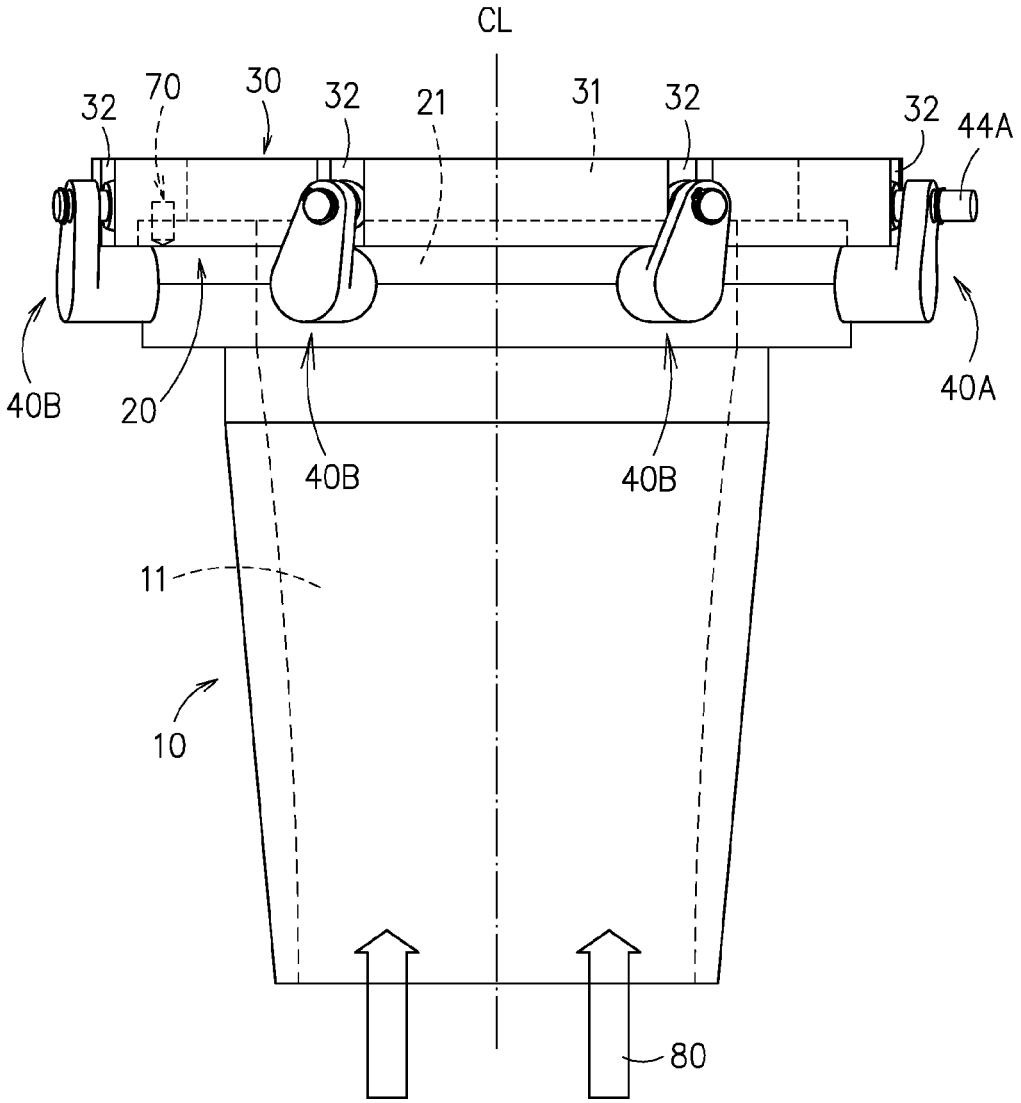
FIG. 3 is a side view of an inlet guide vane assembly of the present disclosure.
Figure 4:
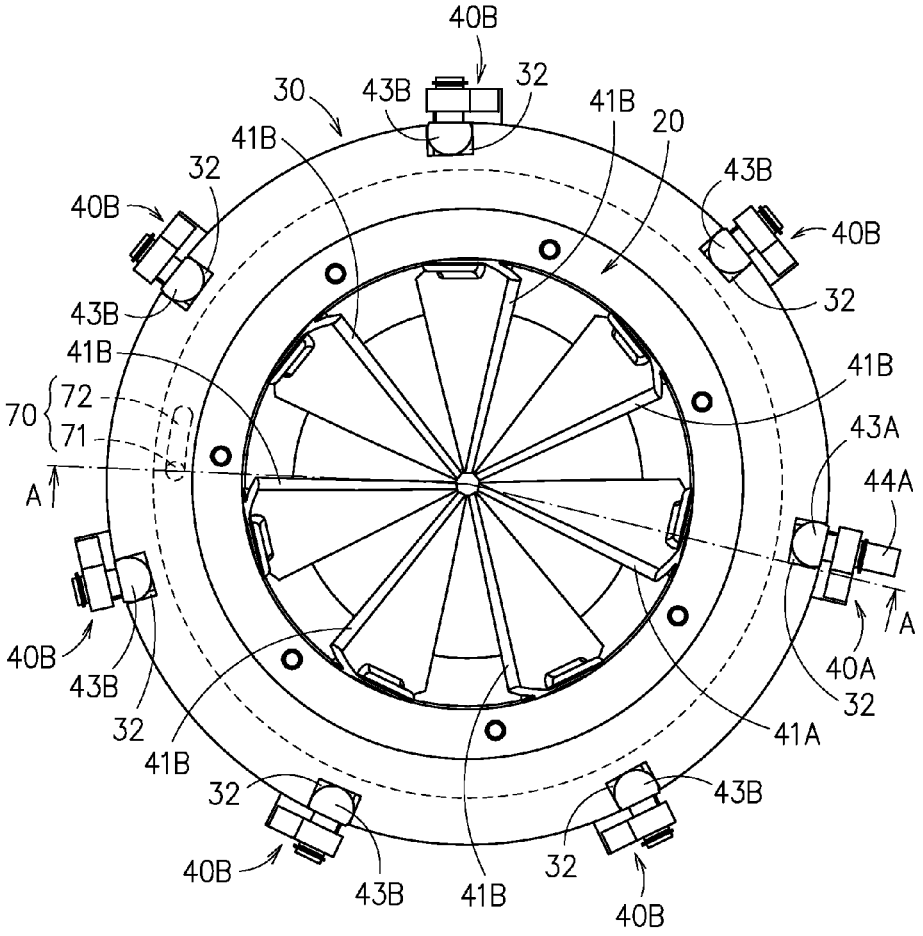
FIG. 4 is a top view of an inlet guide vane assembly of the present disclosure.
Figure 5:
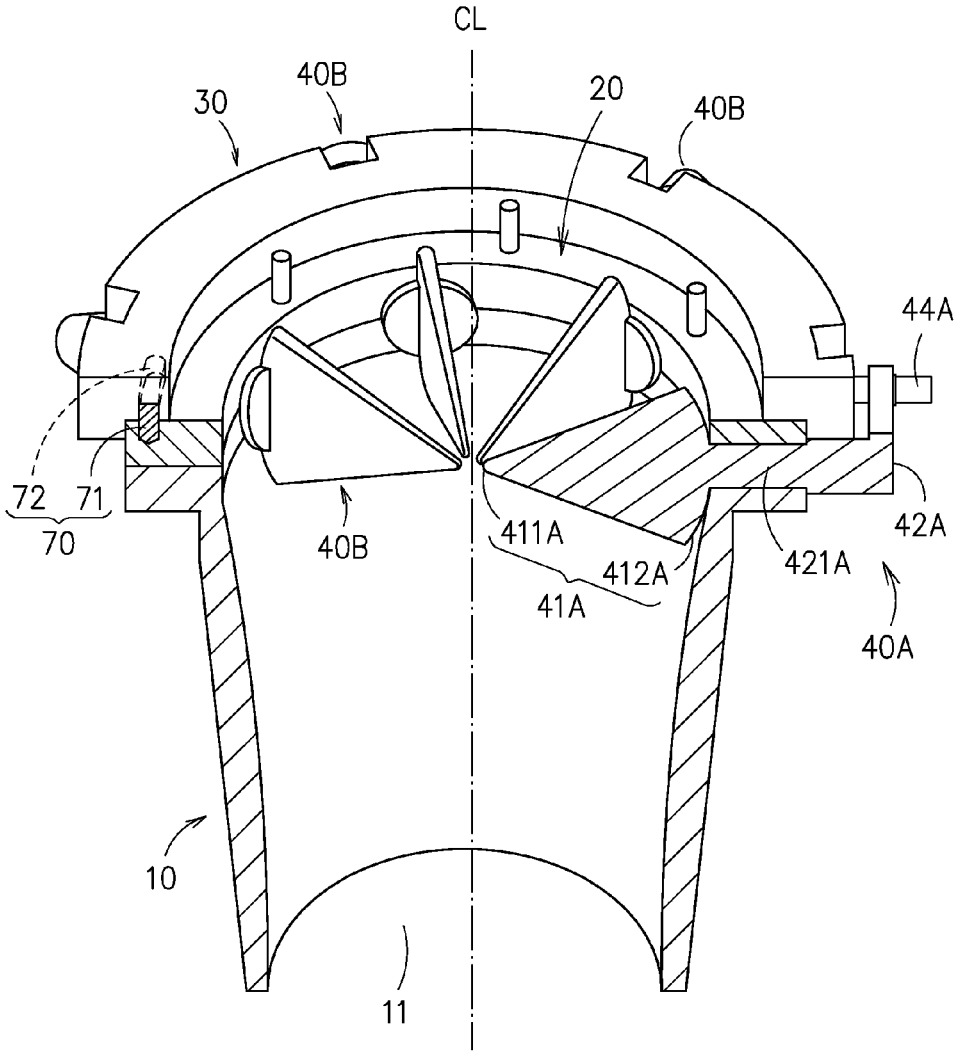
FIG. 5 is an A-A sectional view of the inlet guide vane assembly of FIG. 4.

The housing 10 is formed as a hollow cylinder, as the one shown in FIG. 2, but it is not limited thereby and thus can be a cone-like structure, a tube or an angled tube-like structure. In this embodiment, the housing 10 is configured with a first penetration part 11 and a first end surface 12, whereas the first end surface 12 further has a plurality of first grooves 13 disposed thereat.

The fixing ring 20 is substantially a ring configured with a second penetration part 21 and a first end surface 22, whereas the second end surface 22 further has a plurality of second grooves 23 disposed thereat.

The rotary ring 30 is substantially a ring configured with a central axis in central axial direction CL, is configured with a third penetration part 31 and a plurality of sliding chutes 32 in a manner that the third penetration part 31 is formed along the extension of the central axial direction CL and the plural sliding chutes 32 are disposed surrounding central axial direction CL at the periphery of the rotary ring 30, while enabling each of the plural sliding chutes 32 to extend in a length parallel to the central axial direction CL. Moreover, the rotary ring 30 further has a ring of staircase 33 formed on the inner ring thereof, but it is not limited thereby, whereas there can be a groove formed on the inner ring of the rotary ring 30 instead of the ring of staircase 33.

In this embodiment, since the plural vane units are formed in the same shape, and thus one of the plural vane units, i.e. the vane unit 40A, is selected for illustration. In this embodiment, the vane unit 40A is composed of a vane 41A, a linkage 42A and a sliding block 43A. In addition, the vane 41A, being a fan-like part, is formed with two opposite ends, that is a first end 411A and a second end 412A whereas the first end 411A is formed as an expanded end while the second end 412A is formed as a pointed end. The linkage 42A is connected to an extension rod 421A at an end thereof, whereas the two opposite ends of the extension rod 421A are connected respectively to the expanded end 421A of the vane 41A and the linkage 42A, while allowing another end of the linkage 42A opposite to the end connected to the extension rod 421A to connect to the sliding block 43A; so that the vane 41A and the sliding block 43A are disposed respectively at the two opposite ends of the linkage 42A. Similarly, the vane unit 40B is also composed of a vane 41B, a linkage 42B and a sliding block 43B, and the linkage 42B is also connected to an extension rod 421B. Although there are only one vane unit 40A and two vane units 40B displayed in FIG. 2 for illustration, but there are seven vane units shown in FIG. 1 and FIG. 4, which includes one vane unit 40A and six vane units 40B. However, it is noted that the amount of vane units in the present disclosure is not limited thereby, and the shapes of those vane units can be constructed differently. In this embodiment, for connecting to the driving unit 50, the vane unit 40A is further configured with a coupling shaft 44A, and thus for other vane units 40B that require to connect to the driving unit 50, structures similar to the coupling shaft are also required, but not for those vane units 40B that are not required to connect to the driving unit 50.

As shown in FIG. 1, the driving unit 50 is further configured with a driving rod 51 and an actuating part 52 in a manner that the two opposite ends of the driving rod 51 are arranged coupling respectively to the coupling shaft 44A of the vane units 40A and the actuating part 52, and thereby the driving rod 51 is enabled to be powered and brought to move by the actuating part 52 as the actuating part 52 in this embodiment is substantially a motor, consequently enabling the linkage member 42A of the vane unit 40A that is coupled to the driving rod 51 to swing accordingly.

In this embodiment, by the use of bolts, positioning pins or rivets, the housing is integrated with the fixing ring 20, while allowing the second end surface 22 to be arranged facing toward the first end surface 12, each of the plural second grooves 23 to be disposed mating to a corresponding first groove 13 so as to form an accommodation space. Moreover, the rotary ring 30 is mounted to the exterior of the fixing ring 20 while enabling the fixing ring 20 to be arranged inset to the ring of staircase 33 formed inside the rotary ring 30. It is noted that the ring of staircase 33 for the fixing ring to inset thereat is only an embodiment for illustration, and it is not limited thereby that the rotary ring can be formed with any kind of interior structure only if it is designed for the fixing ring 20 to inset thereat, such as there can be a groove-like structure formed inside the rotary ring 3 provided for the fixing ring 20 to inset thereat. In addition, the first penetration part 11, the second penetration part 21 and the third penetration part 31 are arranged in communication with one another into a passage, by that a fluid 80 is able to flow through first penetration part 11, the second penetration part 21 and the third penetration part 31 sequentially. It is noted that the fluid 80 can be a gas, a liquid or a mixture of liquid and gas. The extension rods 421A and 421B are sandwiched between the accommodation space formed between corresponding first groove 13 and second groove 23, while allowing the vanes 41A and 41B to protrude into the passage formed by the first penetration part 11, the second penetration part 21 and the third penetration part 31, and also enabling the sliding blocks 43A and 43B to inset into the sliding chute 32.

In addition, at corresponding positions on the corresponding fixing ring 20 and the ring of staircase 33 inside the rotary ring 30, there is a position limiting unit 70 to be disposed thereat, and the position limiting unit 70 is configured with a protrusion 71 and an arc-shaped recess 72 formed in a manner that the arc-shaped recess 72 is formed centering around the central axial direction CL and the protrusion 71 is arranged inserting into the arc-shape recess 72, as shown in FIG. 6. In this embodiment, the protrusion 71 is disposed at the fixing ring 20 while the arc-shaped recess 72 is formed on the rotary ring 30, but they are not limited thereby and thus the protrusion 71 is disposed at the rotary ring 30 while the arc-shaped recess 72 is formed on the fixing ring 20. Moreover, there can be more than just one position limiting unit 70.

Figure 6A:
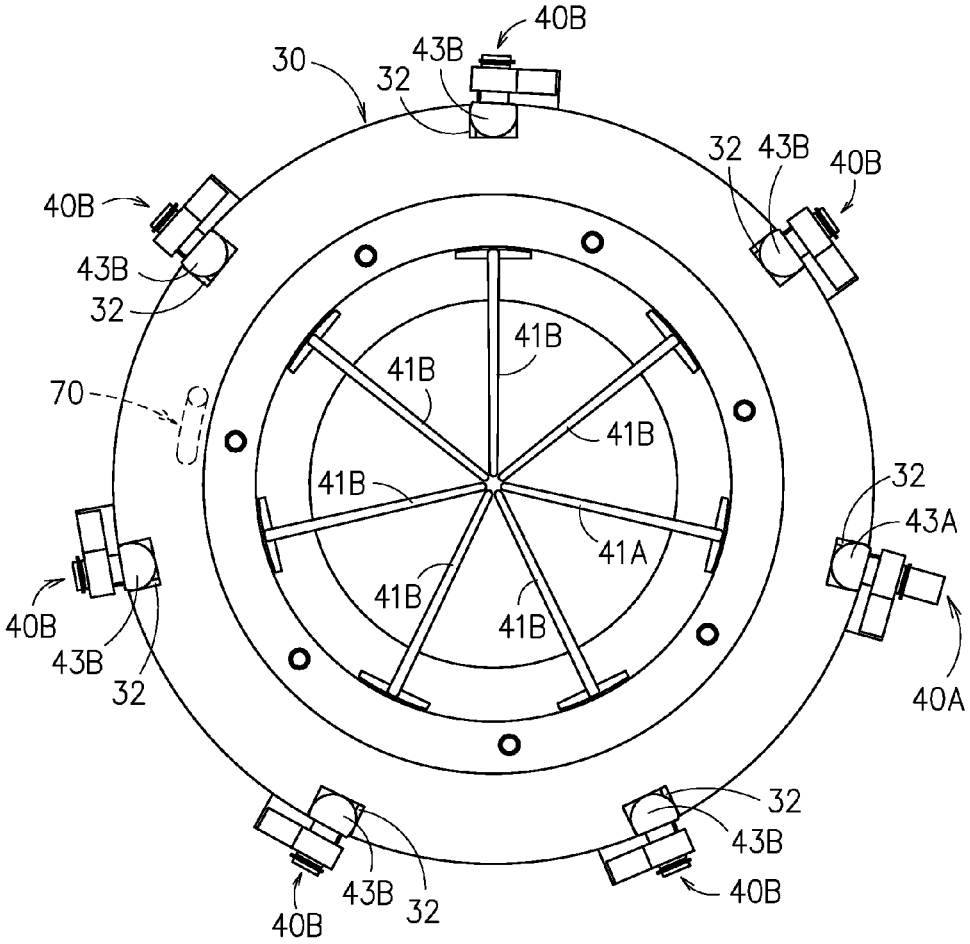
FIG. 6A and FIG. 6B are schematic diagrams showing the inlet guide vane assembly of FIG. 1 in a condition that the vanes are controlled for allowing the passage to open.
Figure 6B:
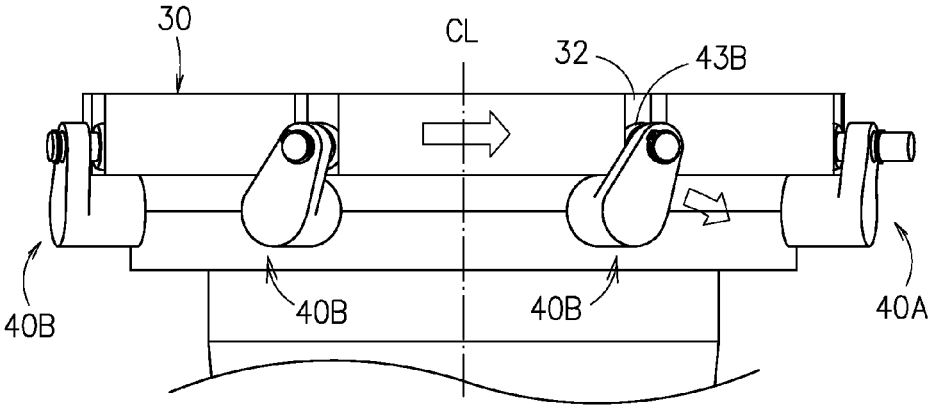
Figure 7A:
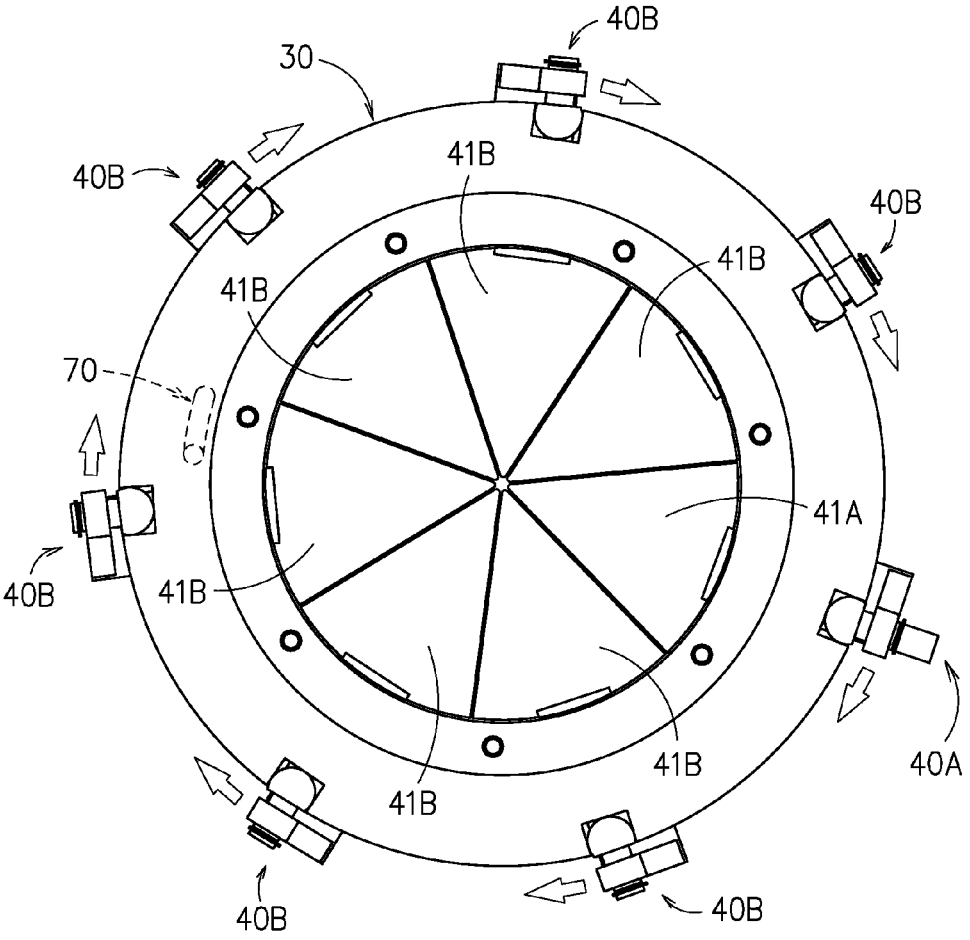
FIG. 7A and FIG. 7B are schematic diagrams showing the inlet guide vane assembly of FIG. 1 in a condition that the vanes are controlled for allowing the passage to close.
Figure 7B:
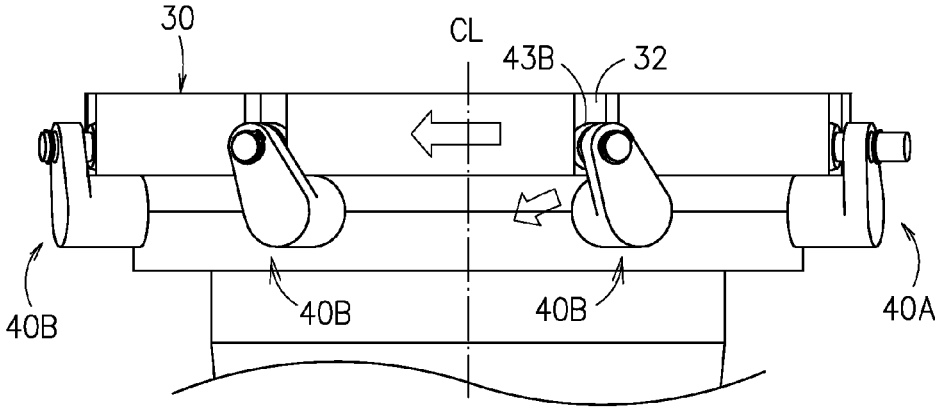

Please refer to FIG. 1, FIG. 6A, FIG. 6B, FIG. 7A and FIG. 7B, which show the operation of an inlet guide vane assembly of the present disclosure. As shown in FIG. 1, FIG. 6A and FIG. 6B, operationally the driving unit 50 that is being activated to move will bring along the linkage 42A of the vane unit 40A to swing which is simultaneously going to cause the sliding block 43A that is coupled to the linkage 42A to move accordingly, and thus enable the rotary ring 30 to rotate about the central axial direction CL, and thereby, the rotating rotary ring 30 will drive the rest of the vane units, i.e. the vane units 40V to swing, enabling the plural sliding blocks 43A, 43B to slide inside their corresponding sliding chutes 32, and the vanes 41A, 41B to flipped from a first state to a second state. As shown in FIG. 6A and FIG. 6B, in a condition when each of the plural vanes 41A, 41B is positioned in the first state, the passage is close by the cooperation of the plural vanes 41A, 41B; and as shown in FIG. 7A and FIG. 7B, in another condition when each of the plural vanes 41A, 41B is positioned in the second state, the passage is open by the cooperation of the plural vanes 41A, 41B. Accordingly, when the driving rod is driven to move reciprocatively, the vane units 40A and 40B are driven to swing reciprocatively thereby and consequently the rotary ring is enabled to rotate reciprocatively. Thereby, as the rotation angles of the vanes 41A, 41B are controlled accordingly, the flow of a fluid flowing through the inlet guide vane assembly can be controlled by the changing guide vane angle. When the vanes 41A and 41B is positioned in a state shown in FIG. 7A, the passage is closed. It is noted that the scale indicator 60 is applied for indicating the rotation angles of the vanes 41A and 41B that is driven by the rotation of the rotary ring 30, and as the rotation of the rotary ring 30 is restricted and limited by the position limiting unit 70, the rotation angles of the vanes 41A, 41B are limited accordingly.

It is noted that the vanes used in the present disclosure can be formed in any shapes at will and are not limited by the vanes shown in the aforesaid embodiments, only if the vanes will not interfere with each other while flipping and can be flip between the first state and the second state smoothly.

Figure 8:
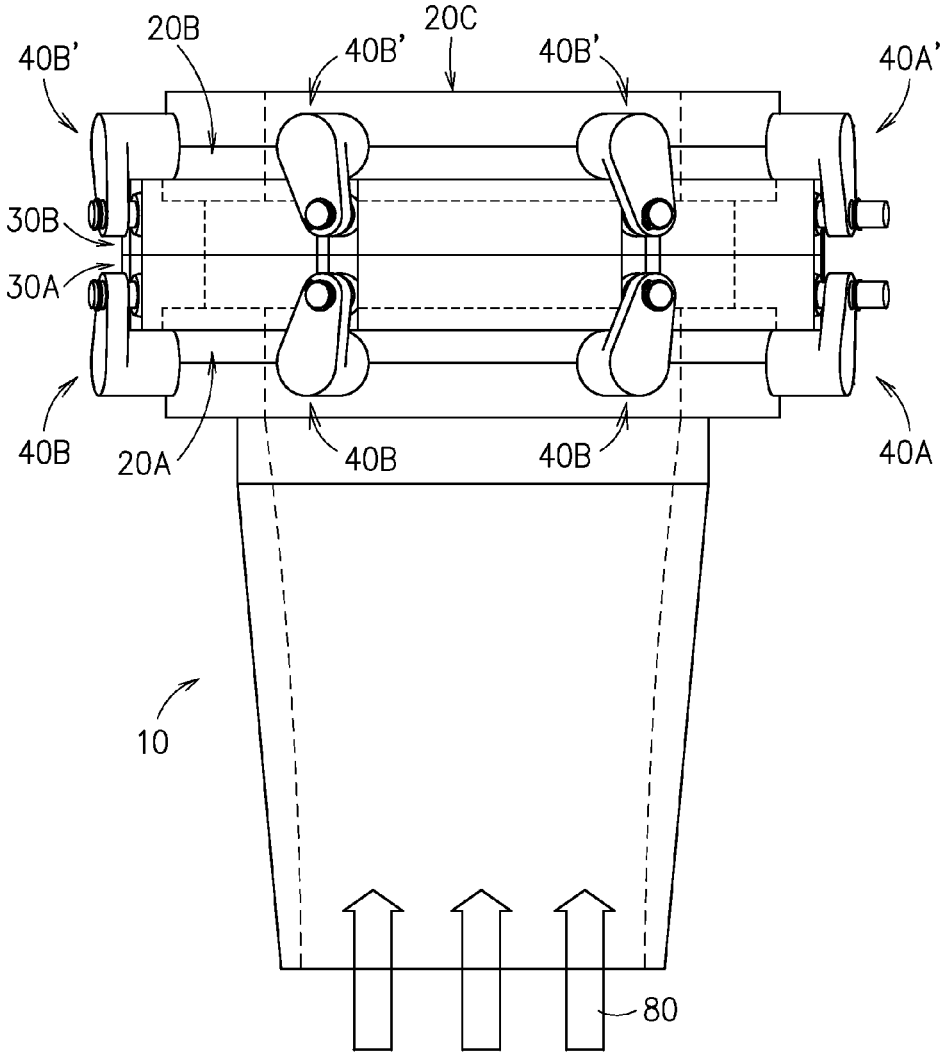
FIG. 8 is a side view of an inlet guide vane assembly according to another embodiment of the present disclosure.

Please refer to FIG. 8, which is a side view of an inlet guide vane assembly according to another embodiment of the present disclosure. The embodiment shown in FIG. 8 is a symmetrical structure, which comprises: a housing 10, a first fixing ring 20A, a second fixing ring 20B, a third fixing ring 20C, two rotary rings 30A, 30B. The two rotary rings 30A and 30B are arranged corresponding to each other; the first fixing ring 20A is disposed at a position between the housing 10 and the rotary ring 30A, and the second and the third fixing rings are disposed at a side of the rotary ring 30B opposite to the side thereof facing toward the housing 10. Moreover, there are a plurality of vane units 40A, 40B being disposed at positions between the first fixing ring 20A and the housing 10 and also there are a plurality of vane units 40A', 40B' being disposed at positions between the second fixing ring 20B and the third fixing ring 20C, while enabling the plural vane units 40A, 40B between the first fixing ring 20A and the housing 10 to be disposed at positions corresponding to the plural vane units 40A', 40B' between the second fixing ring 20B and the third fixing ring 20C.

In addition, the vane unit 40A disposed between the first fixing ring 20A and the housing 10 as well as the vane unit 40A' disposed between the second fixing ring 20B and the third fixing ring 20C are coupled respectively to a driving unit, or can be coupled to the same driving unit. By the aforesaid two-layered vane design, the flow of the fluid 80 can be controlled in a hierarchical control manner.

In the embodiment shown in FIG. 8, either the two rotary rings 30A, 30B can be coupled to each other by the use of bolts or rivets, or the two rotary rings 30A, 30B can be integrally formed, so that the flipping of the vane units 40A, 40B can be synchronized with the flipping of the vane units 40A', 40B'. However, in an embodiment of the present disclosure, the rotation of the two rotary rings 30A, 30B can be independent to each other, whereas the vane units 40A, 40B is enabled to be driven by one driving unit while the vane units 40A', 40B' is enabled to driven by another driving unit, so that the vanes in the vane units 40A, 40B are driven to flip independent to the flipping of the vane units 40A, 40B. Consequently, there can be angular difference between the flipping of the vane units 40A, 40B and the flipping of the of the vane units 40A', 40B', and thereby the flow of the fluid 80 and the angle of the fluid outflow can be controlled accordingly.

In another embodiment, there can be two or more than two inlet guide vane assemblies of FIG. 1 that are arranged serially connected to one another while allowing the inlet guide vane assemblies to be driven respectively or in synchronization for controlling the flipping angles in those inlet guide vane assemblies.

The present disclosure provides an inlet guide vane assembly, which is composed of a rotation transmission mechanism and guide vanes, and can be used for control the flow of a fluid by adjusting the flipping angles of the guide vanes. The inlet guide vane assembly of the present disclosure can be adapted for all kind of machine tools, such as the centrifugal compressor, at different loading conditions for flow adjustment.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. An inlet guide vane assembly, comprising:

a housing, configured with a first penetration part and a first end surface having a plurality of first grooves disposed thereat;

at least one fixing ring, each being arranged coupling to the housing and each configured with a second penetration part and a second end surface having a plurality of second grooves disposed thereat in a manner that each of the plural second grooves is disposed mating to a corresponding first groove so as to form an accommodation space;

at least one rotary ring, each mounted to the exterior of the fixing ring while enabling each to be formed with an central axial direction and configured with a third penetration part and a plurality of sliding chutes in a manner that the third penetration part is formed along the extension of the central axial direction and the plural sliding chutes are disposed surrounding the periphery of the rotary ring, while enabling the first penetration part, the second penetration part and the third penetration part to be arranged in communication with one another into a passage;

a plurality of vane units, each composed of a vane, a linkage and a sliding block in a manner that the vane and the sliding block are disposed respectively at the two ends of the linkage, while allowing the linkage to be sandwiched between one first groove of the plural first grooves and one second groove of the plural second grooves that are arranged corresponding to one another, the vane to protrude into the passage and the sliding block to inset into the sliding chute; and at least one driving unit, comprising a driving rod and an actuating part and disposed coupling to one vane unit selected from the plural vane units for driving the selected vane unit to swing and thus to drive the rotary ring to rotate simultaneously, thereby bringing along the other vanes to swing, enabling the plural sliding blocks to slide inside their corresponding sliding chutes, and consequently the vane is flipped from a first state to a second state, wherein two opposite ends of the driving rod are arranged coupling respectively to one of the plural vane units and the actuating part, and thereby the driving rod is enabled to be powered and brought to move by the actuating part, consequently enabling the vane unit that is coupled to the driving rod to swing accordingly;

wherein each of the at least one fixing ring and the at least one rotary ring is formed as a ring-like part; and each rotary ring further has a ring of staircase formed on an inner ring thereof, while each fixing ring is arranged insetting to a ring of staircase of a corresponding rotary ring; and wherein at corresponding positions on the corresponding fixing ring and rotary ring, at least one position limiting unit is disposed thereat while each position limiting unit includes a protrusion and an arc-shaped recess formed in a manner that the arc-shaped recess is formed centering around the central axial direction and the protrusion is arranged inserting into the arc-shape recess.

2. The inlet guide vane assembly of claim 1, wherein the vane is formed into a fan-like shape, and the linkage is connected to an extension rod at an end thereof while allowing another end of the linkage opposite to the end connected to the extension rod to connect to the sliding block; and the two opposite ends of the extension rod are coupled respectively to the linkage and the expanded end of the fan-shaped vane while allowing the extension rod to be sandwiched between and disposed inside the corresponding accommodation space formed between the engagement of the first end surface and the second end surface.

3. The inlet guide vane assembly of claim 1, wherein the protrusion is disposed at a component selected from the fixing ring and the ring of staircase, while allowing the arc-shaped recess to be formed on another component where there is no protrusion disposed threat.

4. The inlet guide vane assembly of claim 1, wherein the plural sliding chutes are arranged surrounding the central axial direction, while enabling each of the plural sliding chutes to extend in a length parallel to the central axial direction.

5. The inlet guide vane assembly of claim 1, wherein in a condition when each of the plural vanes is positioned in the first state, the passage is close by the cooperation of the plural vanes; and in another condition when each of the plural vanes is positioned in the second state, the passage is open by the cooperation of the plural vanes.

6. The inlet guide vane assembly of claim 1, further comprising:

a scale indicator, arranged coupling to the rotary ring to be used for displaying the flip angles of the vanes.

7. The inlet guide vane assembly of claim 1, having more than one said fixing rings and two of said rotary rings; and the two rotary rings are arranged interconnected to each other, while the more than one said fixing rings includes a first fixing ring, a second fixing ring and a third fixing ring to be arranged in a manner that the first fixing ring is disposed at a position between the housing and one of the two said rotary rings while allowing more than one of the plural vane units to be disposed between the first fixing ring and the housing, and the second and the third fixing rings are disposed at a side of another rotary ring of the two said rotary ring that is facing away from the housing while allowing more than one of the plural vane units to be disposed between the second rotary ring and the third rotary ring.

8. The inlet guide vane assembly of claim 7, wherein the vane units that are disposed between the first fixing ring and the housing and the vane units that are disposed between the second fixing ring and the third fixing ring are symmetrically arranged.

9. The inlet guide vane assembly of claim 7, wherein one vane unit selected from the vane units that are disposed between the first fixing ring and the housing and one vane unit selected from the vane units that are disposed between the second fixing ring and the third fixing ring are connected the same driving unit of the at least one driving unit, and in a condition when there are more than one said driving units, the two selected vane unit is connected respectively to two different driving units selected from the more than one said driving units.

10. The inlet guide vane assembly of claim 7, wherein the two said rotary rings are symmetrically arranged.

11. The inlet guide vane assembly of claim 7, wherein the two said rotary rings are integrally formed.

* * * * *